United States Patent [19]

Morel et al.

[11] 4,132,621

[45] Jan. 2, 1979

[54] METHOD OF IMPROVING THE CURRENT SUPPLY OF ELECTROLYSIS CELLS ALIGNED IN A LENGTHWISE DIRECTION

[75] Inventors: Paul Morel, Le Vesinet; Jean-Pierre Dugois, Ste. Jean de-Maurinne; Bernard Langon, Lannemezan, all of France

[73] Assignee: Aluminum Pechiney, Lyon, France

[21] Appl. No.: 868,861

[22] Filed: Jan. 12, 1978

[30] Foreign Application Priority Data

Jan. 19, 1977 [FR] France ..... 77 02213

[51] Int. Cl.[2] ..... C25C 3/16

[52] U.S. Cl. ..... 204/243 M; 204/244

[58] Field of Search ..... 204/243 R, 243 M, 244–247

[56] References Cited

U.S. PATENT DOCUMENTS

| | | | |
|---|---|---|---|
| 3,756,938 | 9/1973 | Nebell | 204/244 X |
| 3,969,213 | 7/1976 | Yamamoto et al. | 204/244 |
| 4,049,528 | 9/1977 | Morel et al. | 204/243 M |
| 4,072,597 | 1/1978 | Morel et al. | 204/243 M |

FOREIGN PATENT DOCUMENTS

| | | | |
|---|---|---|---|
| 434135 | 10/1974 | U.S.S.R. | 204/244 |
| 458616 | 2/1975 | U.S.S.R. | 204/243 M |

*Primary Examiner*—John H. Mack
*Assistant Examiner*—D. R. Valentine
*Attorney, Agent, or Firm*—McDougall, Hersh & Scott

[57] ABSTRACT

The invention relates to a method of improving the current supply of electrolysis cells such as used in the production of aluminum by igneous electrolysis of alumina dissolved in cryolite, in which the cells are aligned in a lengthwise direction, allowing the harmful influence of the induced magnetic fields to be reduced.

In a series, each cell is supplied with current from the preceding cell both via the head and via at least one side riser. The output of the cathode bars are divided into two separate groups, the upstream group supplying the head of the subsequent cell and the downstream group supplying the side risers of the subsequent cell. This produces a substantial improvement in the efficiency and a greater regularity.

3 Claims, 20 Drawing Figures

METHOD OF IMPROVING THE CURRENT SUPPLY OF ELECTROLYSIS CELLS ALIGNED IN A LENGTHWISE DIRECTION

The present invention relates to a method of improving the current supply of igneous electrolysis cells and more particularly of series of cells intended for the production of aluminum by electrolysis of alumina dissolved in molten cryolite and aligned in a lengthwise direction.

It is in fact known that such cells are almost universally of lengthened rectangular shape and that they are connected electrically in series. It is possible to arrange the cells within a building for protection, with the cells either side by side, that is to say so that the large side of each cell is perpendicular to the axis of the series or head-to-head, that is to say so that the large side of each cell is parallel to the axis of the series.

The invention will be described with reference to the accompanying drawings, which are given by way of illustration and not by way of limitation, in which FIG. 1 is a transverse vertical sectional view of electrolysis cells forming a part of a head-to-head series;

Figure 2:
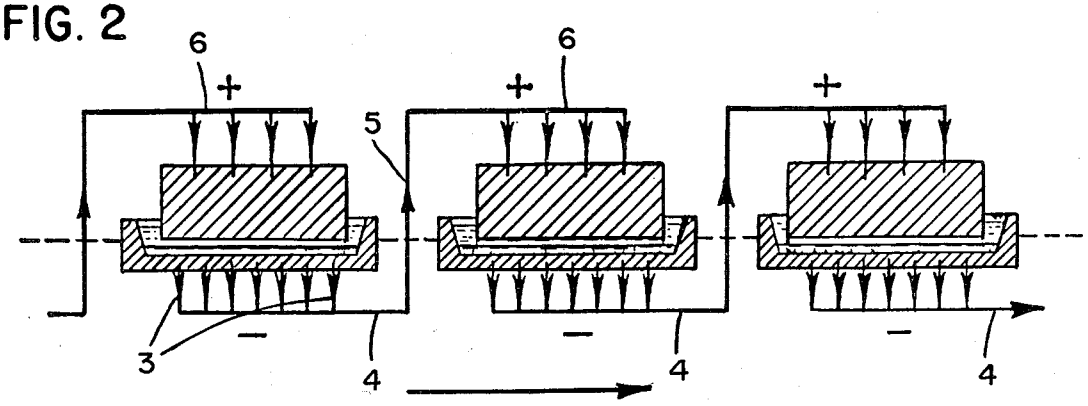
FIG. 2 is a lengthwise vertical sectional view of the cells shown in FIG. 1.

It is customary to distinguish the heads of the cells by the terms "upstream" and "downstream" with reference to the direction of the current in the series. Each cell comprises a metal shell 1 provided with blocks of carbon 2 which act as a cathode. Metal bars 3 submerged in the blocks of carbon collect the current leaving the cell. This current is brought to the busbars 4 which conducts it through the side riser 5 to the subsequent cell onto conductors 6 forming the beam on which the anodes 7 are suspended. The electrolytic bath is at 8 and the layer of liquid aluminum is formed at 9 on the cathode 2.

In this arrangement, which is quite conventional, the cathode outputs of each cell thus supply the subsequent downstream cell via the upstream head. In addition, it is known that the manufacturing costs of these cells per unit production are improved substantially when they are increased in size; it is normal to operate under amperage which reach and even greatly exceed 100,000 amperes.

At these levels of power, the influence of the magnetic field produced by the current passing in the conductors is no longer negligible. The Laplace forces cause, in the electrolytic bath, a hydrostatic deformation of the bath-metal interface and hydrodynamic movements of the metal which cause it to move permanently and promote its dispersion in the bath, hence reducing the current efficiency. These forces also cause significant unevenness of the layer of liquid aluminum which gives rise to short circuits with the anodes, irregular wear of the anodes and oscillating movements of the liquid aluminum, even causing splashes outside the cell.

The manufacturers are perpetually preoccupied with the control of these fields and compensation for their effects, and numerous solutions have been proposed. German Pat. No. 1,010,744 of "Vereinigte Aluminium Werke, A. G." describes a method of improving the current supply of electrolysis cells aligned in a lengthwise direction by supplying the said cells either via the upstream head and the downstream head or via the upstream head and a side riser, but the two circuits upstream head-downstream head or upstream head-side riser are connected by an equipotential conductor which has the disadvantages of making the conductors much heavier and of making it necessary to determine precisely the cross-section thereof in order suitably to distribute the current.

In French Pat. No. 1,143,879 of the Company Pechiney, description is made of a method of reducing the unevenness of the molten metal in electrolysis cells of high amperage and more particularly in the lengthwise series of cells equipped with continuous anodes (so-called "Soederberg" anodes). This method is based upon an analysis of the different components of the magnetic field induced by passing the continuous electrolysis current into the cell and into the connecting conductors. For this purpose, the central point O of the bottom of the crucible of the electrolysis cell is considered and a system of rectangular coordinates is defined in three dimensions: the horizontal axis O$x$ runs in the direction of the current, parallel to the large sides of the cell, the O$y$ axis in the same horizontal plane is perpendicular to O$x$, thus parallel to the small sides of the cell, and the O$z$ axis rises vertically, thus perpendicular to the $x$O$y$ plane and the O$xyz$ trihedron is direct. $\vec{B}$ is the value of the magnetic field at a given point and B$x$, B$y$ and B$z$ are the projections of $\vec{B}$ on O$x$, O$y$ and O$z$. $\vec{J}$ is the value of the density of the current and J$x$, J$y$ and J$z$ the projections of $\vec{J}$ on O$x$, O$y$ and O$z$.

The method forming the subject of French Pat. No. 1,143,879 consists in cancelling out the magnetic effects at point O. These effects remain over the rest of the cell but they are relatively weak and their value comprises a certain symmetry in relation to the point O, thus providing sufficient stability in the functioning of the cell. In order to obtain this result, it has been shown that the following conditions must be satisfied at point O:

$$By = 0$$

$$dBy/dz = 0$$

Figure 3:
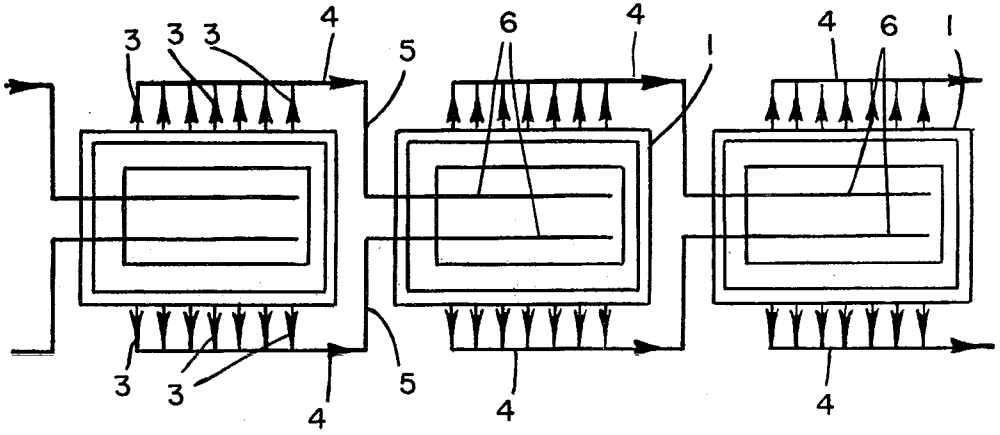
FIG. 3 is a plan view of the cells shown in FIGS. 1 and 2.
Figure 1:
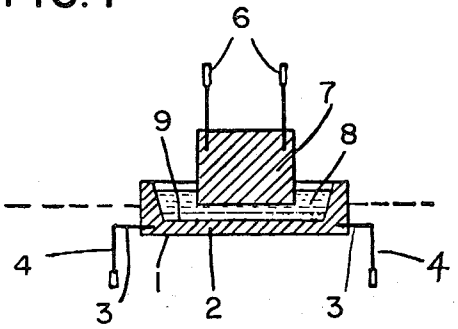
Figure 4:
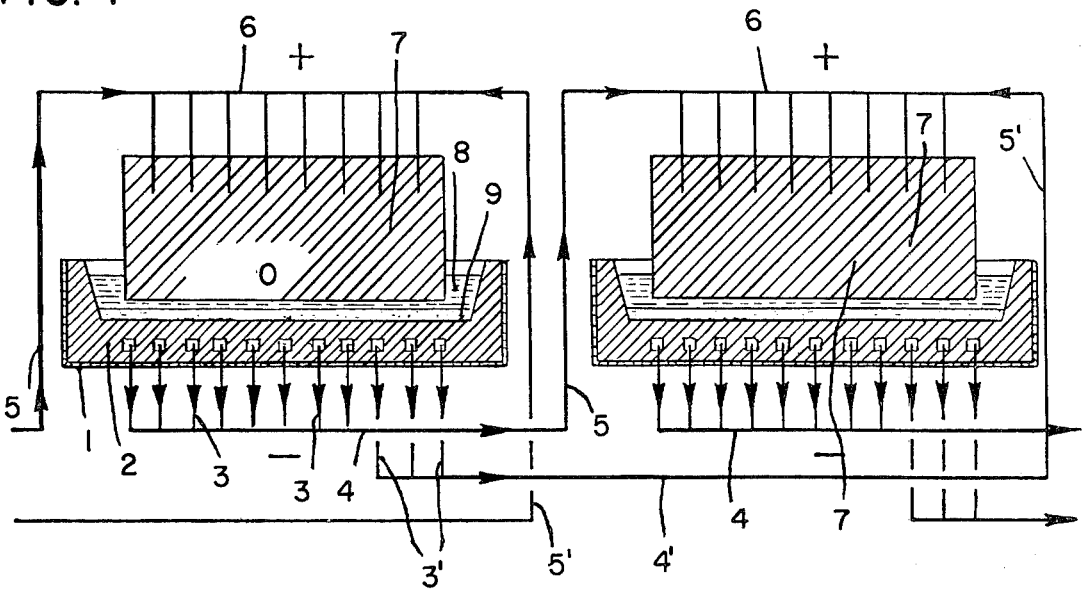
FIG. 4 is a longitudinal vertical sectional view of two cells forming a part of a lengthwise series in which the conductors are arranged in accordance with the French Pat. No. 1,143,878.
Figure 5:
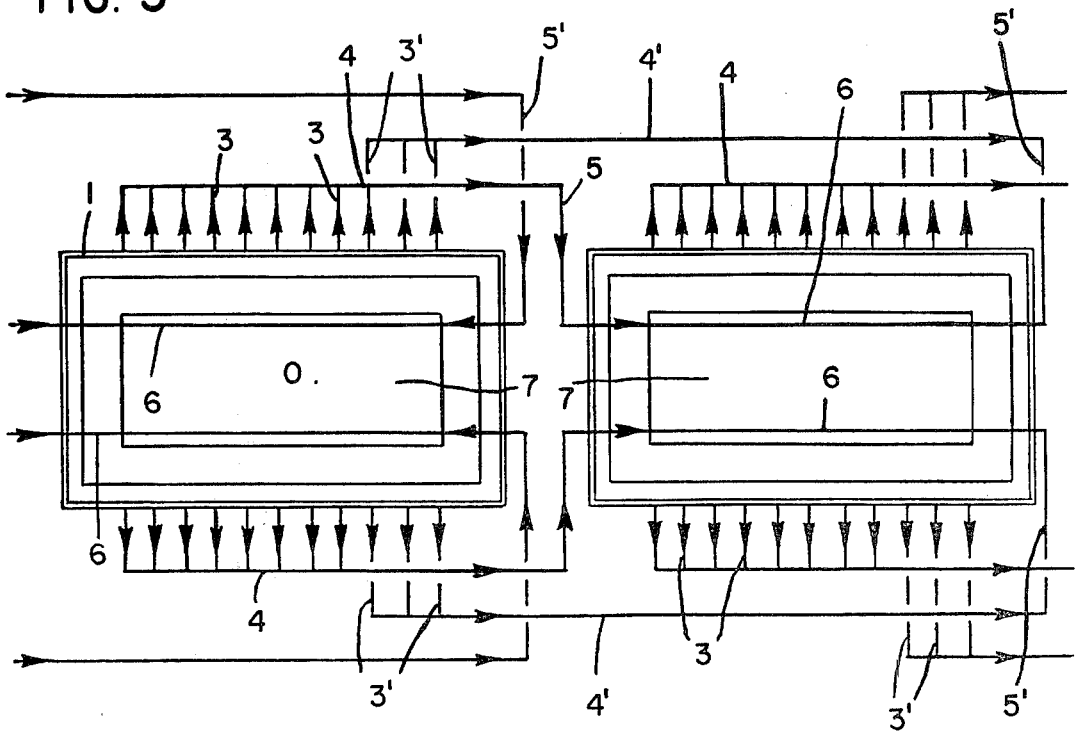
FIG. 5 is a plan view of the cells shown in FIG. 4.

Referring to FIGS. 4 and 5 which show a lengthwise vertical section and a plan view respectively of two cells forming part of a lengthwise series functioning at 70,000 amperes, the conductors have been arranged according to the teaching of French Pat. No. 1,143,879 so as to satisfy the two conditions $By = 0$ and $dBy/dz = 0$ at point O. The 22 cathode outputs (11 for each side of the cell, this number being determined by the man skilled in the art by considerations of current density in the conductors), are separated into two groups of eight and three bars. The two groups of eight upstream bars 3 are connected to the conductors 4 which supply the upstream head of the subsequent cell via the riser 5 whereas the two groups of three downstream rods 3' are connected to the conductors 4' which supply the downstream head of the subsequent cell via the riser 5'. Although the arrangement in FIGS. 1, 2 and 3 hardly allows 50,000 amperes to be exceeded, the arrangement in FIGS. 4 and 5 has allowed a stable and regular flow to be obtained at 70,000 amperes with a current efficiency of between 86 and 87%. However, this arrangement has turned out to be insufficient beyond 100,000 amperes and, even at lower levels of current it allows a magnetic field to exist and does not allow a current efficiency of the order of 87% to be exceeded, a value considered insufficient by aluminum producers. The present invention, which will now be described, relates to a method of improving the current supply of series of electrolysis cells for the production of aluminum aligned in a lengthwise direction, in which the efficiency can be increased very substantially at equal electrolysis current which may exceed the values described above. However, it also allows, with but little modification, the series of continuous anodes to be transformed into series of pre-baked anodes.

In accordance with the practice of this invention, the production of aluminum can be increased correlatively by about 30% without modifying the size of the cells and at the same time allowing a current efficiency at least equal to 88% owing to improved compensation of the effect of the induced magnetic fields and resultant Laplace forces.

The invention consists in separating the cathode outputs of each side of the cell into at least two groups which are substantially equal in number and in supplying the beam of the subsequent cell separately both via the upstream head and via at least one side riser on each side of the cell connected to an intermediate point of the beam situated between the upstream head and the downstream head. In this arrangement, the conductors connect each group of cathode rods to the upstream head and to the intermediate points of the cross-head respectively via the risers of the subsequent cell, the conductors being separate and having their cross-section calculated so that each circuit conveys a substantially equal proportion of the total electrolysis current.

In a particular embodiment of the invention, the cathode rods on each side of the cell in row "$n$" are divided into two separate groups containing a substantially equal number of rods, the upstream group supplying the upstream head of the cross-head of the cell in row $n+1$, and the "downstream" group supplying a collector situated substantially in the center of the cross-head via a side riser on each side of the cell.

In another particular embodiment of the invention, which is particularly suitable for series at very high amperage, for example at 150,000 amperes and even higher, the cathode rods on each side of the cell in row $n$ are divided into three separate groups, the upstream group supplying the downstream head of the cross-head of the subsequent cell in row $n+1$, the central group supplying a first side riser on each side of the cell situated substantially in the first third of the upstream side of the beam, and the downstream group supplying a second side riser on each side of the cell situated substantially two thirds (from upstream) along the beam.

In the drawings, FIGS. 1–5 represent the prior art. FIGS. 6–9, 19 and 20 represent arrangement embodying features of this invention.

Figure 6:
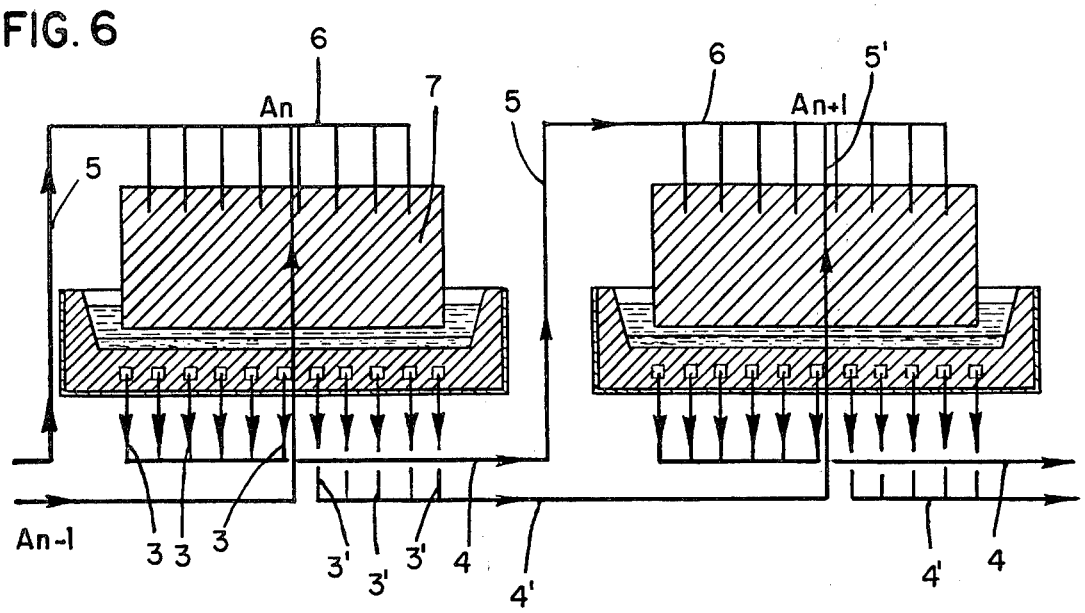
FIG. 6 is a diagrammatic view in longitudinal vertical section of a head-to-head arrangement of electrolysis cells, the conductors of which are arranged in accordance with the practice of this invention.
Figure 7:
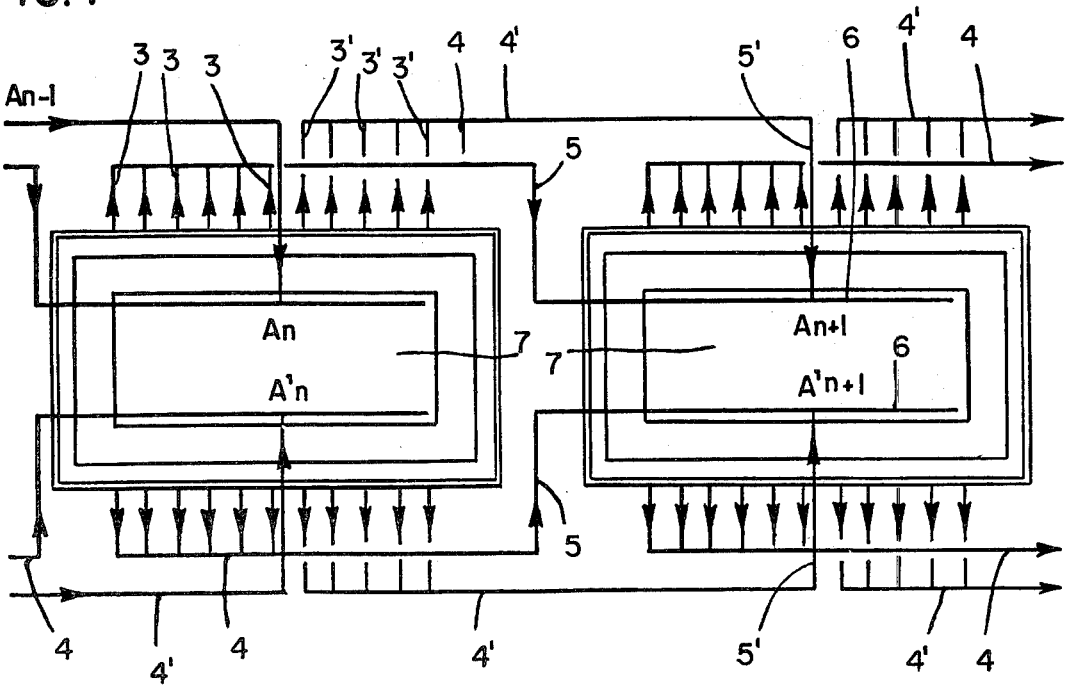
FIG. 7 is a plan view of the arrangement shown in FIG. 6.

In these different figures, the connecting conductors have been shown diagrammatically so as to make the drawings legible but the arrangement therein is not necessarily identical to their actual positioning. In particular, the cathode outputs are generally placed in a horizontal plane. In FIGS. 6 and 7, the cell in row $n$ in the series is supplied via conductors coming from the previous cell in row $n-1$ situated upstream and it supplies the subsequent cell in row $n+1$ situated downstream via conductors arranged identically. The arrows show the conventional direction of circulation of the current in the different conductors. The two branches of the beam of the cell $n$ are supplied both via the upstream head and via two intermediate points A and A'. The 11 cathode outputs on each side of the cell, are divided into two groups, one group of six on the upstream side, (reference 3) and one group of five on the downstream side (reference 3'). The six cathode outputs upstream 3 supply the beam 6 of the cell $n+1$ via the head upstream, via the collector 4 and the riser 5. The five downstream cathode outputs 3' supply the intermediate point A via the collector 4' and the riser 5.

Since the cell is symmetrical, the same arrangement is found on the other side so as to supply the two branches of the beam at A and A'. Although the embodiment of the invention allows a certain amount of freedom in the distribution of the cathode outputs between the upstream group and in the downstream group as well as in the choice of the positioning of points A and A' on the beam, it appears that the best results are obtained when the cathode outputs are distributed into two substantially equivalent groups and when the points A and A' are located substantially at the level of the transversal median plane of the anode. The total length of the group of conductors supplying the upstream head of the cross-head is thus very substantially equal to the total length of the group of conductors supplying the intermediate points A and A' of the beam and this allows rods of the same cross-section to be used in the two circuits.

Figure 8:
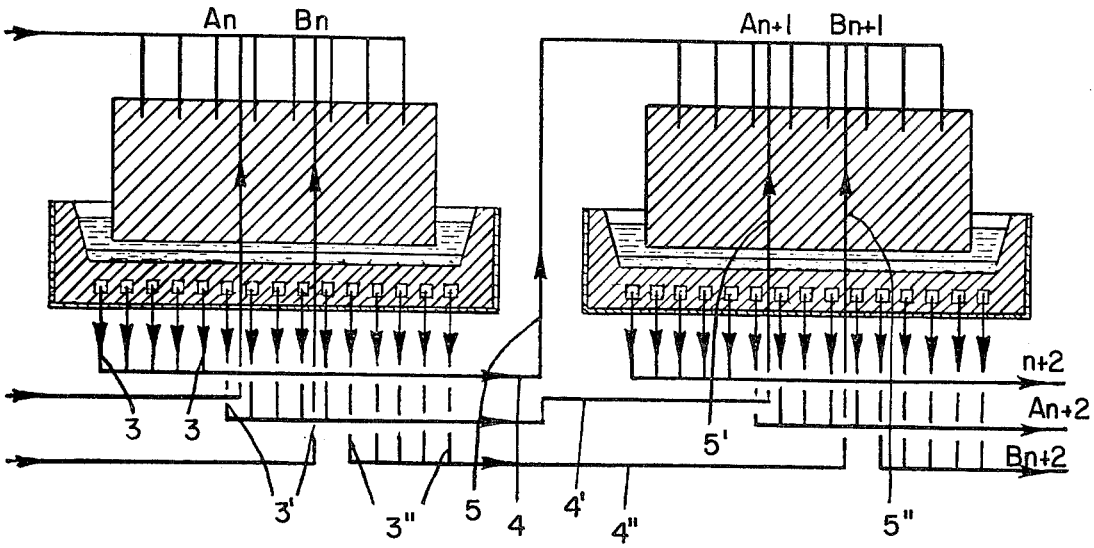
FIG. 8 is a diagrammatic, longitudinal sectional view of another arrangement of conductors embodying the features of this invention adapted for very high amperage cells.
Figure 9:
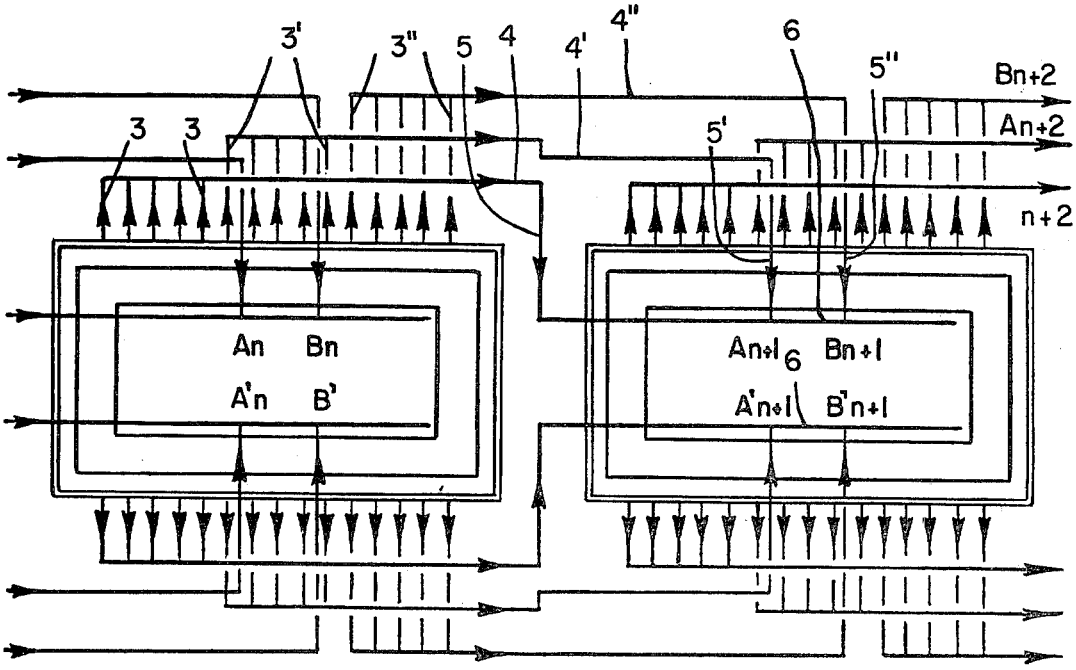
FIG. 9 is a plan view of the arrangement shown in FIG. 8.

FIGS. 8 and 9 show a longitudinal vertical section and a plan of two cells in a head-to-head series, the connecting conductors of which are also arranged in accordance with the invention. This is a series of very high amperage (150,000 amperes) in which the cathode outputs contain 15 bars on each side of the cell, thus a total of 30, which are separated into three groups for each side. The downstream group of five bar 3 of the cell in row $n$ is connected to the head of the beam 6 of the cell in row $n+1$ via the conductor 4 and the side riser 5. The group of five central bars 3' of the cell in row $n$ is connected to an intermediate point 1 situated in the first upstream third of the beam via the conductor 4' and the side riser 5'. The downstream group of five bars 3" of the cell in row $n$ is connected to a second intermediate point B of the cell in row $n+1$ situated two thirds of the way along the beam via the conductor 4" and the side riser 5". Since the cell is symmetrical, the same arrangement is found on the other side for supplying the point A' and B' of the cross-head. It is noted in FIGS. 6 and 7 as well as FIGS. 8 and 9 that the conductors 4 and 5 on the one hand, and 4' and 5' on the other hand or 4 - 5, 4" - 5" are substantially equal in length thus allowing bars of equal cross-section to be used.

Figure 10:
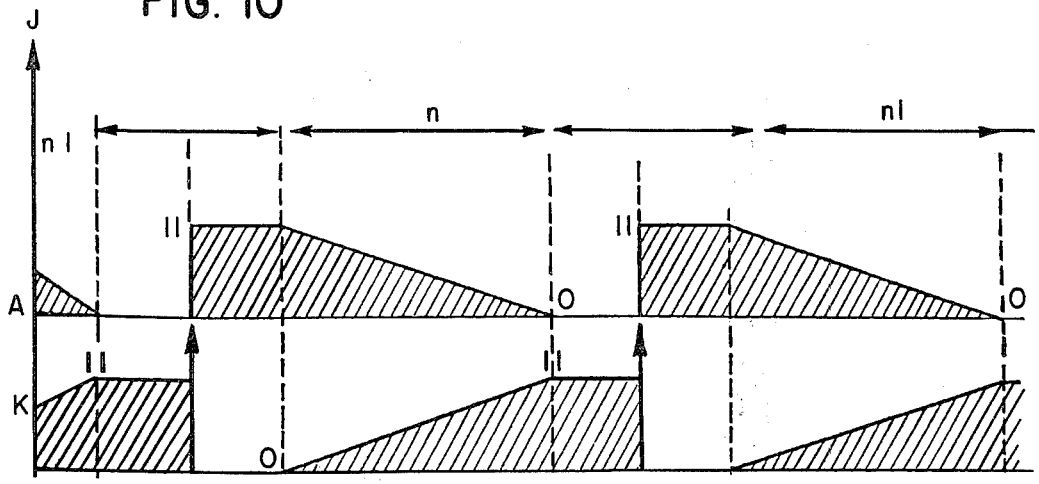
FIGS. 10, 11 and 12 illustrate the distribution of current in the anode and cathode conductors in accordance with the prior art and in accordance with the practice of the invention, the arrangement of conductors corresponding to that of FIGS. 2, 4 and 6 respectively.
Figure 11:
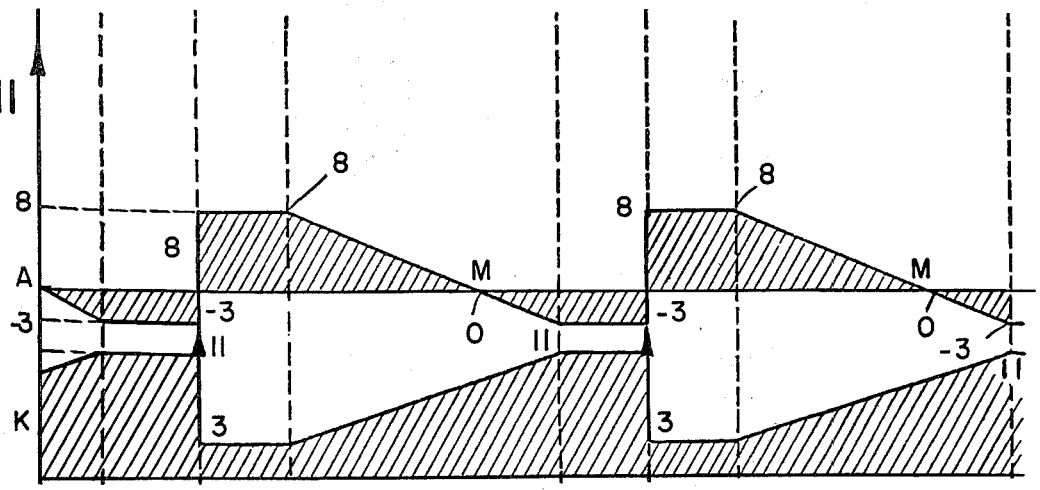
Figure 12:
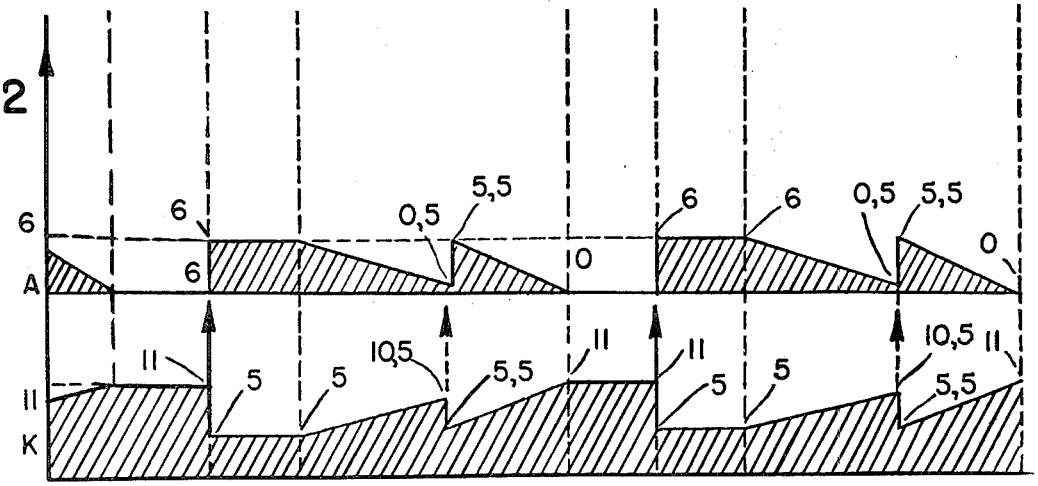

FIGS. 10, 11 and 12 show the distribution of the current in the anode and the cathode conductors along a head-to-head series of cells. FIG. 10 relates to a series according to the prior art in which the cross-head of each cell is only supplied via the upstream head from cathode bars of the previous cell.

FIG. 11 relates to a series according to the teaching of French Pat. No. 1,143,879 in which the beam of each cell is supplied by two heads, the upstream head from eight upstream cathode bars of the preceding cell and the downstream heads from three downstream bars of the preceding cell.

FIG. 12 relates to the subject matter of the invention: the beam of each cell is supplied via the upstream head from six upstream cathode bars of the preceding cell and at an intermediate point situated substantially in the center thereof, from the five downstream cathode rods of the preceding cell.

In the three Figures, the length of the cells and the horizontal projection of the connecting circuits are shown as abscissa on an arbitary scale and amperage of the current as ordinates on an arbitary scale.

The graphs represented by the letter A relate to the anode conductors and those represented by the letter K relate to the cathode conductors. The vertical arrows show the position where the cathode current from the cell $n-1$ becomes the anode current of the cell $n$, positioned arbitarily in the center of the space separating the downstream head of one cell from the upstream head of the subsequent cell.

As the cells are symmetrical about a longitudinal vertical plane, only the conductors (anode and cathode) on one side have been considered and, owing to the fact that there are eleven cathode bars on each side, the strengths have been expressed in a fraction 1/11, 1 being equal to half the total amperage which runs through the series.

It is observed that the distribution of the amperage along the anode and cathode conductors is improved very distinctly and, in particular, that the retrogression of anode current (point −3) which existed in the case in FIG. 11 between the downstream head and the point M has disappeared (the minus sign indicating that the anode current circulates in the opposite direction to the general direction of the current in the series). The advantages of the invention appear even more clearly by mapping the values of the magnetic field induced at different points of an electrolysis cell in the plane of the bath aluminum interface.

Figure 13:
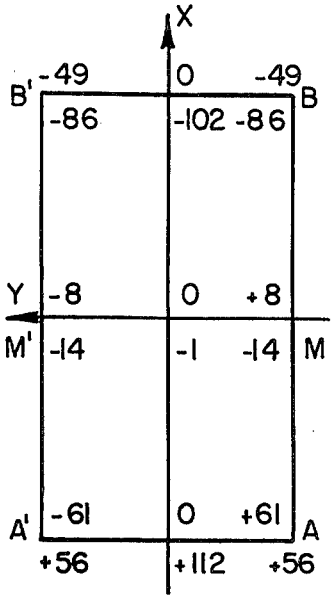
FIGS. 13, 14 and 15 show the strength of magnetic fields at various points in the interface in an aluminum bath in a cell of the prior art.
Figure 14:
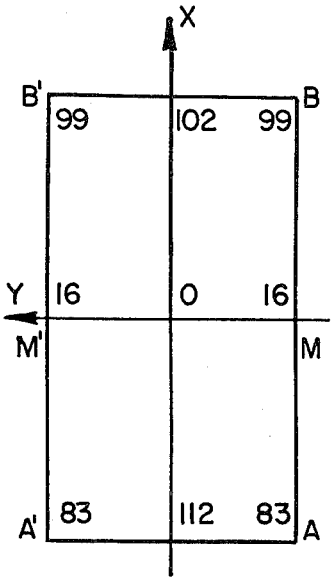
Figure 15:
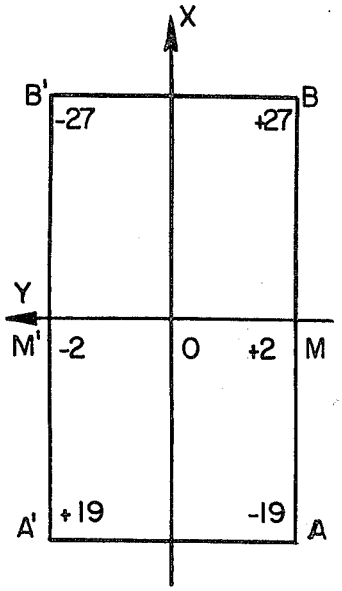
Figure 16:
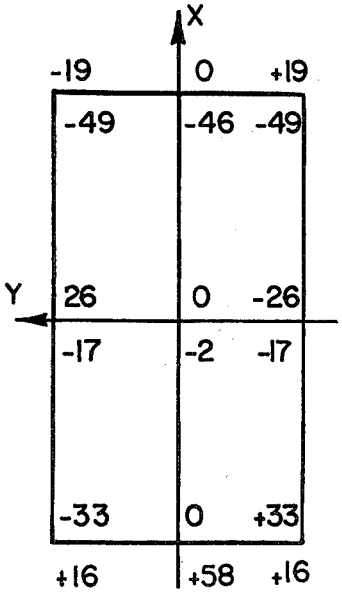
FIGS. 16, 17 and 18 show the strength of magnetic fields at various points at the interface in an aluminum bath in a cell embodying the features of this invention.
Figure 17:
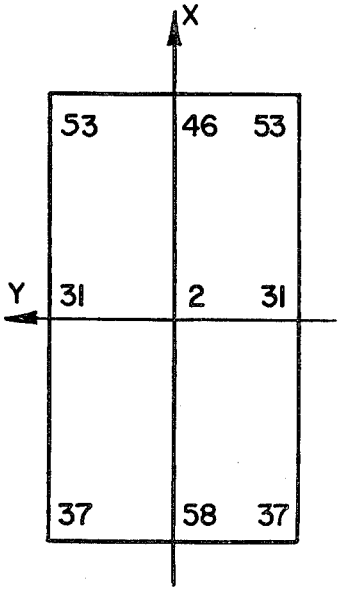

FIGS. 13, 14 and 15 relate to an electrolysis cell according to French Pat. No. 1,143,879 (supply by the two heads) and FIGS. 16, 17 and 18 relate to a cell according to the invention. In FIGS. 13 and 16, the upper numeral indicates the component B$x$ of the magnetic field and the lower numeral the component B$y$ of the magnetic field at nine points on the anode surface of the cell: at the four corners, in the center of the four sides and in the center. In FIGS. 14 and 17, the numeral indicates the value of the resultant B$xy$ (vectoral composition of B$x$ and B$y$).

Figure 18:
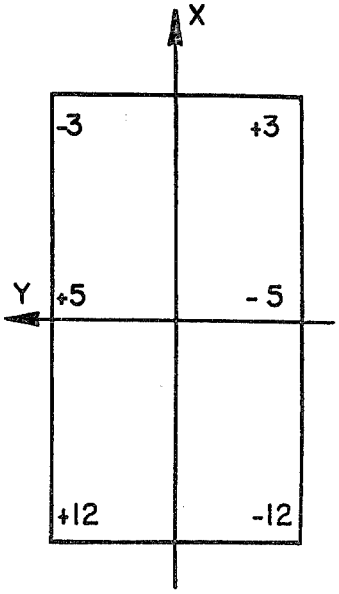
Figure 19:
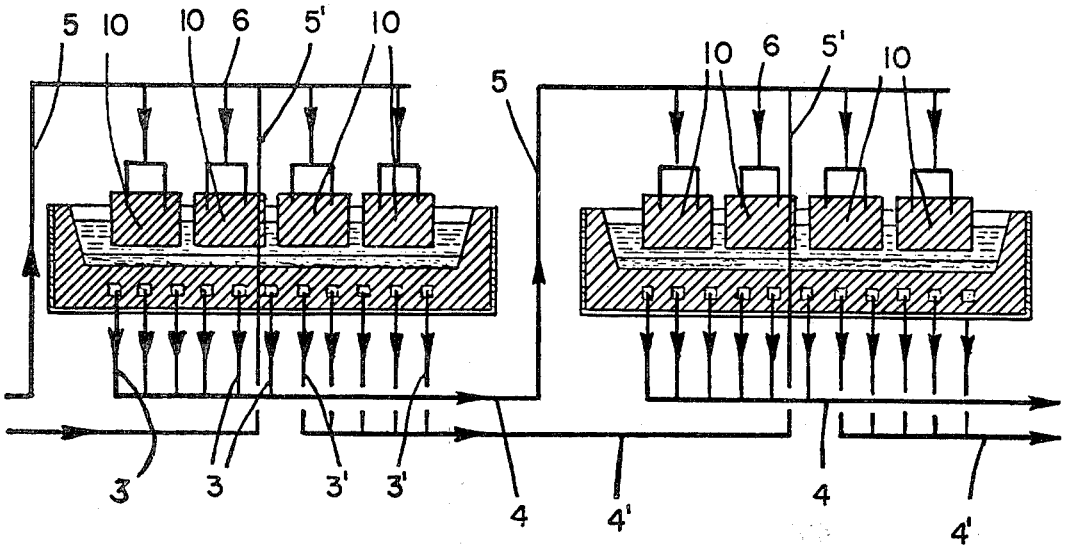
FIG. 19 is a longitudinal, sectional view of an arrangement of conductors embodying the features of this invention as applied to cells having prebaked anodes.
Figure 20:
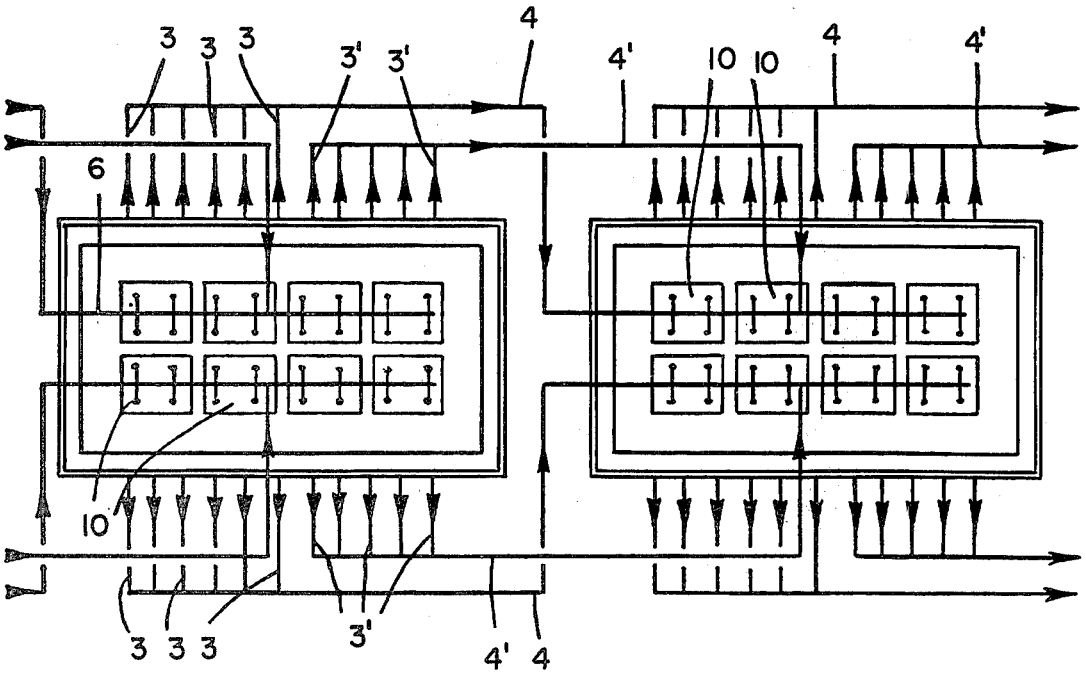
FIG. 20 is a plan view of the arrangement shown in FIG. 19.

It is observed that the embodiment of the invention leads to a very substantial reduction of B$xy$ at the two ends and a considerable reduction of the difference between the field in the center and the field at the end of the cell. In FIGS. 15 and 18, the numerals represent the values of the vertical fields B$z$ according to the prior art (FIG. 15) and according to the invention (FIG. 18). It is also observed that the embodiment of the invention leads to a significant reduction of B$z$ in the corners and a substantial reduction in the discrepancy between the different values of this field along the large sides. Finally, another great advantage of the invention, compared to French Pat. No. 1,143,879, lies in the significant saving in aluminum bars for forming the supply circuits.

If the circuits in FIG. 5 (prior art) are compared with those in FIG. 7 (according to the invention), it is observed that, according to the invention, the circuits 3 + 4 + 5 and 3' + 4' + 5' are of equal and minimum length while, according to the prior art, the circuit 3' + 4' + 5' is clearly longer than the circuit 3 + 4 + 5. In order to prevent the cathode of the preceding cell from being unbalanced, it is necessary to use a current density (A/cm2) for the circuit 3' + 4' + 5' which is clearly less than that of the circuit 3 + 4 + 5, thus different from the so-called "economical" density. As this weak density is applied to the longest circuit, this results in a great increase in the weight of the conductors which also increases in proportion to the size of the cell, whereas in the arrangement according to the invention where the current density Δ is equal in each circuit, it may be taken equal to the optimum most economical value Δ.

For a cell of 90,000 amperes, the difference in weight on the connecting conductors favors the cell according to the invention by 8%, thus about 1,000 kg of aluminum rods per cell. For a cell of 150,000 amperes, this gain is of the order of 1,800 kg.

Experience has shown that the presence of one or even of two side risers on each side of the electrolysis cells does not obstruct the machines for servicing the cells such as those for crust breaking, supplying alumina and drawing of liquid aluminum, when they are of the semi-gantry type or travelling crane type as described in particular in French Pat. Nos. 1,245,598 (Pechiney) and 1,526,766 (Pechiney).

EXAMPLE

A "lengthwise" series of electrolysis cells provided with Soederberg anodes operating at 70,000 amperes and connected in accordance with FIGS. 4 and 5 (prior art) produced 485 kg of aluminum per cell per day, corresponding to a current efficiency (Faraday efficiency) of 86% which may be considered to be insufficient. Without changing the boxes, the continuous Soederberg anodes 7 were replaced with pre-baked anodes 10 according to FIGS. 19 and 20 in which two times four anodes have been shown in order to simplify the drawings whereas the exact number is actually 2 times 10.

The connections were made in accordance with FIGS. 6 and 7, according to the invention, so as to reduce the interferences caused by the magnetic field. In addition, owing to the fact that the continuous anode was replaced by pre-baked anodes, it was possible to increase the amperage the series changed in this way from 70,000 to 90,000 amperes, thus an increase of 28.6%. The production of aluminum increased to 640 kg per cell per day corresponding to a Faraday efficiency of 88%. Despite the increase of 28.6% in the amperage which would have brought about a correlative increase in the magnetic fields if the arrangement of conductors had not been changed, the modified series functioned stably and uniformly.

The embodiment of the invention thus allows the existing series to be improved by very substantially increasing their Faraday efficiency, by reducing the interferences caused by the magnetic field and allows the amperage to be increased, while at the same time, maintaining a high efficiency.

It is also possible to apply particular arrangements to the conductors arranged in accordance with the invention in order to compensate the magnetic field inducing by the adjacent row of cells.

We claim:

1. A method of improving the current supply of electrolysis cells aligned in a lengthwise direction in order to reduce the interferences caused by the induced magnetic field, comprising dividing the cathode output bars on each side of the cells into at least two separate groups containing a substantially equal number of bars, and supplying the beam of the cell in row $n$ with current both via the upstream head from the upstream group of cathode bars of the cell in row $n-1$ and via at least one side riser on each side connected to at least one intermediate point in the beam situated between the upstream head and the downstream head from the downstream group of cathode bars of the cell in row $n-1$.

2. A method of improving the current supply of electrolysis cells aligned in a lengthwise direction according to claim 1, in which the cathode output rods on each side of the cells are divided into two separate groups containing a substantially equal number of bars and in which the cross-head of the cell in row $n$ is supplied with current both via the upstream head from the upstream group of cathode bars of the cell in row $n-1$ and via a side riser on each side connected to a point in the cross-head situated substantially in the center of the said cross-head from the downstream group of cathode bars of the cell in row $n-1$.

3. A method of improving the current supply of electrolysis cells aligned in a lengthwise direction according to claim 1, in which the cathode output bars on each side of the cells are separated into three independent groups containing a substantially equal number of bars and in which the beam of the cell in row $n$ is supplied with current both via the upstream head from the upstream group of cathode bars of the cell in row $n-1$, via a first side riser on each side connected to a point of the cross-head situated substantially at "upstream" one-third of this from the central group of cathode bars of the cell in row $n-1$, and via a second side riser on each side connected to a point of the cross-head situated substantially upstream two-thirds from the downstream group of cathode rods of the cell in row $n-1$.

* * * * *